US006092407A

United States Patent [19]

Wabnitz

[11] Patent Number: 6,092,407

[45] Date of Patent: Jul. 25, 2000

[54] RING BENDING MACHINE

[75] Inventor: Josef Wabnitz, Haldenwang, Germany

[73] Assignee: Zopf Biegemaschinen Handels GmbH, Haldenwang, Germany

[21] Appl. No.: 09/133,376

[22] Filed: Aug. 13, 1998

[30] Foreign Application Priority Data

Aug. 26, 1997 [DE] Germany ..... 297 15 262 U

[51] Int. Cl.[7] ..... B21D 7/08

[52] U.S. Cl. ..... 72/31.04; 72/137; 72/145; 72/171; 72/173

[58] Field of Search ..... 72/173, 171, 175, 72/135, 145, 137, 31.04

[56] References Cited

U.S. PATENT DOCUMENTS

| | | | |
|---|---|---|---|
| 972,928 | 10/1910 | Schneider | 72/145 |
| 1,262,944 | 4/1918 | Haldeman | 72/145 |
| 1,338,946 | 5/1920 | Meyers | 72/171 |
| 2,335,028 | 11/1943 | Rose | 72/171 |
| 3,074,465 | 1/1963 | Huet | 72/145 |
| 3,430,474 | 3/1969 | Mann | 72/173 |

FOREIGN PATENT DOCUMENTS

| | | | |
|---|---|---|---|
| 137519 | 6/1988 | Japan | 72/135 |

*Primary Examiner*—Daniel C. Crane
*Attorney, Agent, or Firm*—Shlesinger Arkwright & Garvey, LLP

[57] ABSTRACT

The invention relates to a ring bending machine for pipes and metal profile rods comprising two supporting shafts supported in spaced relation to one another in a carrier plate and rotatably driven, and a pressing shaft arranged centrically with respect to the two supporting shafts in a rotatable and adjustable manner, a slender cover housing surrounding the carrier plate, the shafts and their driving means, wherein in front of a first face side of which, on shaft ends protruding from the housing, bending rollers adapted to a profile to be processed and defining a bending plane are arranged. The invention further more relates to a supplementary frame for a ring bending machine.

13 Claims, 2 Drawing Sheets

RING BENDING MACHINE

FIELD OF THE INVENTION

The invention relates to a ring bending machine for pipes and metal profile rods comprising two supporting shafts supported in spaced relation to one-another in a carrier plate and rotatably driven, and a pressing shaft arranged centrically with respect to the two supporting shafts in a rotatable and adjustable manner, a slender cover housing surrounding the carrier plate, the shafts and their driving means, wherein in front of a first face side of which, on shaft ends protruding from the housing, bending rollers adapted to a profile to be processed and defining a bending plane are arranged. The invention furthermore relates to a supplementary frame for a ring bending machine.

BACKGROUND OF THE INVENTION

Ring bending machines of the mentioned or of a similar type are used for annular- or ring-bending of metal pipes or solid profile rods with an adjustable bending radius in a bending plane. Such machines are common with locksmiths or plumbers (building plumbers) in order to provide bent sleepers or parts for example for railings or fences, or also bends in water pipes or heating system pipes. However, it is not possible to manufacture railing parts for spiral stairs, corresponding to a cylindrical helix (helical gradient), with such a bending machine, which provides bendings only in a single plane, i.e. the bending plane.

In order to bend pipe- or rod-shaped railing parts lying on a cylinder jacket or to bend a cylindrical coiled tubing comprising one or more turns (for example a heating or cooling coil to be housed in a cylindrical boiler or vessel), specially formed, expensive spiral bending devices are known, which, due to their high costs, can only be used cost-effectively in large firms, where an adequate work-load can be guaranteed.

It is an object of the present invention to provide an improved ring bending machine of the aforementioned type, which can easily and cost-effectively be transformed or extended into a coil or spiral bending machine, in order to be able to bend pipes or profile rods only in the ring bending plane, or with an additional helical or coil gradient extending transversely or perpendicularly to the ring bending plane.

Due to the inventive concept it is possible to convert, if the need arises, a space-saving, compact and robust ring bending machine by means of a supplementary frame having a simple and accessible structure for the manufacturing of spiral- or coil- shaped bends in a short space of time, so that the desired ring or coils bends of the metal pipes or profile rods can be provided in an exact and reproducible manner. To this effect, there are provided the two displaceable carriages for the positioning of the pressure roller, which are easily surveyable and accessible as well as exactly adjustable inside the supplementary frame mounted on the outside of the cover housing of the bending machine. The exact adjustment with respect to similar work pieces is reproduceable for repetitive bendings even if performed after intermediate bending of other pieces or after long interruption periods. The supplementary frame for performing spiral-shaped bendings can remain in its mounted state without interfering with the functioning of the machine with respect to bending operations on metal profiles solely in the ring bending plane.

In order to achieve an optimal adaptation with respect to a given space and to material feeding conditions, as well as the further transportation of bent work pieces, the ring bending machine, with or without the supplementary frame, can be operated with an arbitrary orientation, e.g. with a vertical or horizontal ring bending plane, without in any way having to accept inferior bending results. It must only be made sure that for the carrier plate, which supports the supplementary frame and all functionally important parts of the machine and to whose form the cover housing enclosing it is adjusted, there is provided, at least at its connection area adjacent to the two driven rollers, a secure connection to a robust machine or engine bed.

Typically, with ring bending machines of the aforementioned general type, a longish or elongated, slender rectifier roller is provided in the area of the runout (exit) of the profile behind the final bending roller, which has the task of holding or bending back the bent pipe profile in a homogeneous and uniform way in the ring bending plane defined by the bending rollers against its inherent stresses due to its longitudinal welding seam, which causes unwanted distortions. If this rectifier roller is transversely adjustable with respect to the ring bending plane, the annularly bent profile can be provided with a lateral bend in the sense of a helical gradient behind the final bending roller. Results of bending experiments conducted in this connection have, however, proved to be of no value, because an adjustment or displacement of the rectifier roller, which is supported at its spaced apart ends, can only be achieved in an inaccurate and cumbersome manner, and furthermore is possible only without taking into consideration the respective bending radius, and also because, due to the proximity of the rectifier roller to the exit behind the final bending roller, a danger of overstressing and non-uniform material deformations for the pre-bent pipe exists, and because, until a desired helical gradient is achieved, numerous trial runs are necessary, and even these cannot guarantee a uniform and reproduceable bending result.

According to a preferred embodiment of the ring bending machine the outline of the face sides of the cover housing, conforming to the carrier plate, corresponds to an isosceles trapezium, so that the supplementary frame can be selectively, according to the helical direction, by being mounted on one of the narrow sides of the cover housing forming the inclined (slanted) trapezium sides, fixedly aligned therewith.

Advantageously, the supplementary frame comprises two side plates stiffened with respect to one another in a spaced relation. The side plates partly cover the cover housing at its face sides and comprise connecting bores, which are aligned with respect to existing through-bores of the carrier plate and the cover housing for fixedly attaching a rectifier roller.

For calibration or retrieval of specific or known adjustment positions of the pressure roller markers displaceable with the first and/or second carriages can be provided, which cooperate with scales or dials stationarily provided on the supplementary frame or on the first carriage. In order to achieve similar results, digital counters coupled to the screw spindles of the first and second carriages with optical or acoustical indicating means can be provided alternatively or additionally.

According to a further embodiment of the ring bending machine according to the invention the second carriage can be guided in an upper member of the block-shaped first carriage protruding from the side plates of the supplementary frame, whereby the pressure roller supported on the second carriage is arranged at a substantial distance from the final bending roller forming the exit or outlet of the machine. Thus, the bending stresses induced by the pressure roller in the profile to be bent can be distributed over a larger profile length, whereby a uniform and continuous bending deformation in the sense of the helical gradient can be achieved, and nonuniform stresses, for example leading to kinks or flaws in the profile, can be avoided.

BRIEF DESCRIPTION OF THE DRAWINGS

Further features and advantages of the ring bending machine and the supplementary frame according to the invention can be seen from the following description of a preferred embodiment with respect to the drawings.

DETAILED DESCRIPTION OF THE PREFERRED EMBODIMENTS

Figure 1:
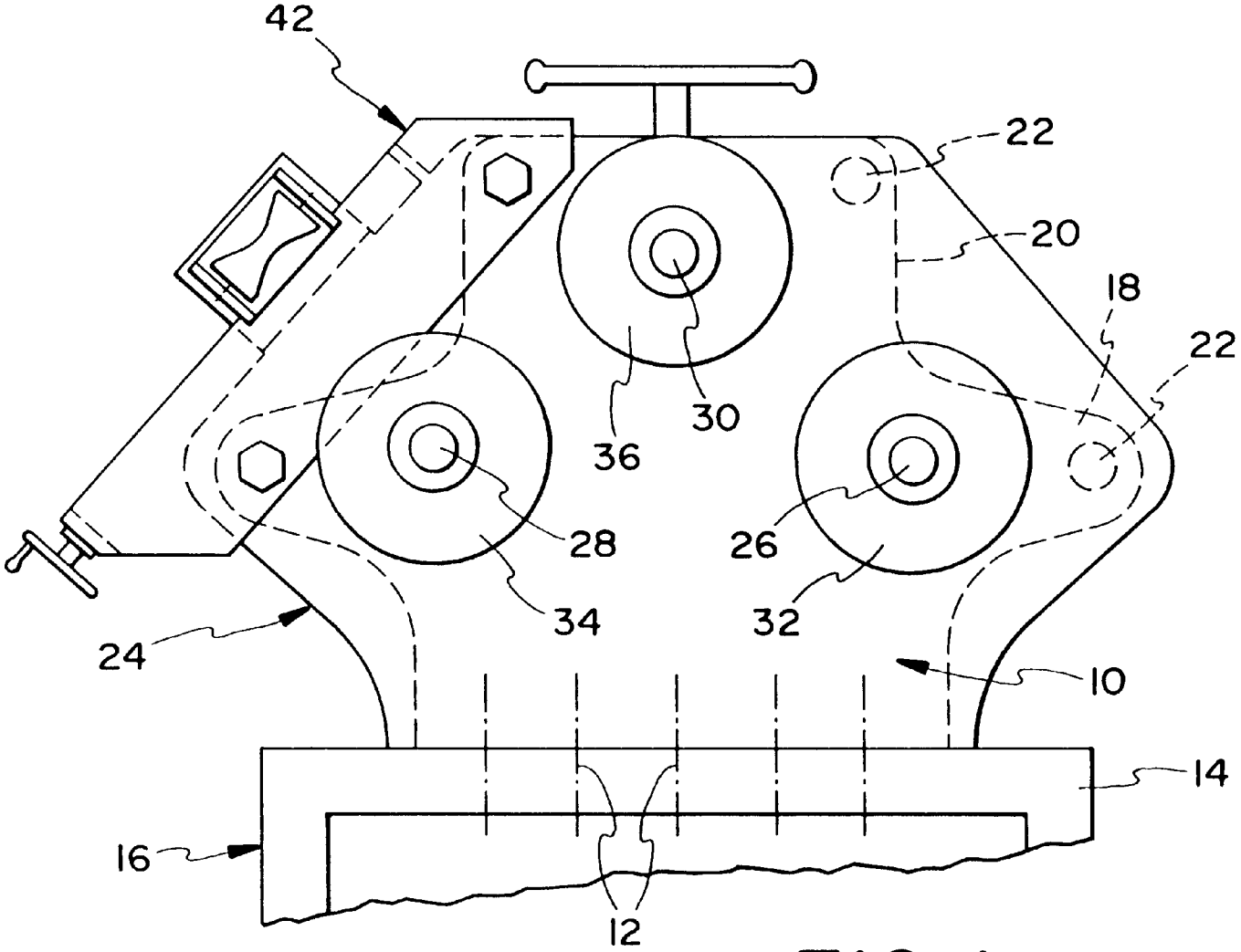
FIG. 1 shows a schematical front view of the ring bending machine according to the present invention with the mounted supplementary frame for adjustable helical gradients of the profile to be bent.

A bending machine forming part of the invention comprises a solid carrier plate 10, the outlines of which are indicated in FIG. 1, and whose foot end rests on the base plate 14 of a machine frame 16 and is fixedly attached by means of screws 12. The symmetrically shaped carrier plate 10 comprises protruding side wings 18 and an upper extension 20, the end areas of which include respective through-bores 22, which are optionally provided for the mounting of rectifier rollers or for connecting a supplementary frame, as will be described below. Two supporting shafts 26, 28 are mounted in the carrier plate with horizontal spacing to one another. Shafts 26, 28 are synchronously driven by a motor (not shown) mounted on the base plate 14 and a multistage toothed wheel reducing gear. The bedding of a pressing shaft 30 arranged centrically between the two supporting shafts 26,28 is vertically guided in the upper extension 20 of the carrier frame and height-adjustable by means of an upper spindle drive conducted or guided towards the outside (not shown).

Carrier plate 10, shafts 26, 28, 30 and their drive and adjusting means are surrounded by a cover housing 24, the outline of which, in a general approximation with respect to the carrier plate, essentially corresponds to an isosceles trapezium. At the front side of the housing there is provided, parallel to the inclined trapezium sides, a respective rectifier roller, the bedding or bearing parts of which (provided on both sides thereof) are fastened by means of fitting screw bolts penetrating the through bores 22 of the carrier plate 10 and connecting openings of the housing aligned therewith.

The cover housing 24, which is trapeze shaped in its outlines, is relatively slender or narrow in a direction perpendicular to the drawing plane. Lower bending rollers 32, 34 driven in the same rotational direction, as well as an upper following-on bending roller 36, the circumference of which is adapted to the profiles to be treated, are exchangeably fastened on shaft ends protruding from the face side of the cover housing 24. By lowering the upper bending roller 36 in the direction of the centre of the distance between the bending rollers 32, 34, the profile in the shown example according to FIG. 1, which approaches from the right hand side, is annularly or ring bent to the set bending radius in the defined vertical bending plane. The annularly bent profile extends upwardly inclined at the exit of the bending machine behind the final bending roller 34 and rests at a location of the rectifier roller usually positioned behind the exit, the rectifier roller being relatively long in order to rectify and transport profiles of various bending radii.

Figure 2:
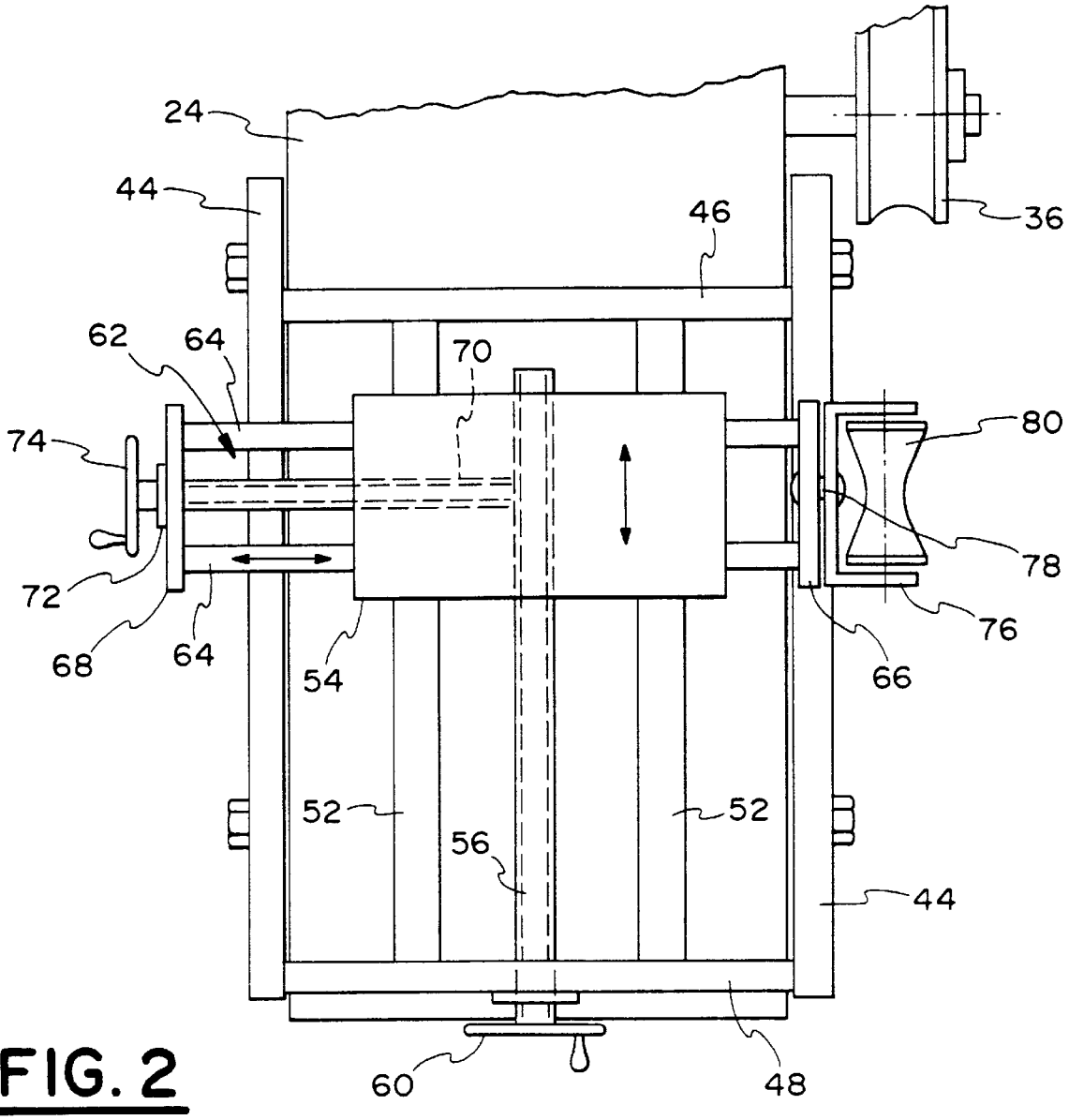
FIG. 2 shows a schematical plan view of the supplementary frame according to FIG. 1, wherein the positioning with respect to the bending housing supporting it and to the final bending roller is indicated.

In order to additionally bend a profile, hitherto provided with a bending radius, in a helical or spiral manner, according to the invention there is provided a supplementary frame 42 which serves to form helical gradients and which is provided, as shown in FIG. 2, with two longish side plates 44 stiffened in a spaced relationship to one another. The supplementary frame is, according to FIG. 1, arranged on a narrow side of the cover housing 24 corresponding to the inclined trapeze side, the side plates 44 resting on front and rear face sides of the cover housing and partly covering these.

The side plates 44 comprise connecting bores 50, the positions and distances of which are provided according to the corresponding through-bores 22 in the carrier plate 10 and in the cover housing 24.

When the supplementary frame 42 rests on the narrow side of the cover housing 24 with its transverse stiffenings 46, 48, which are provided on both sides, and is adjacent to the face or broad side of the cover housing with its side plates 44, it is largely supported and guided, so that by means of a small longitudinal displacement of the supplementary frame its connecting bores can be aligned with respect to the through-bores 22 and suitable fitting screw bolts can be inserted and tightened therein.

According to the plan view of the supplementary frame, two guiding columns 52 extending parallelly to the side plates 44 are attached to the transverse stiffenings 46, 48. A first carriage 54, in the shown embodiment consisting of a block-shaped member, is guided on the guiding columns 52. The carriage is displaceable by means of a screw-spindle 56 stationarily provided on the transverse stiffening 48 and engaging a screw member fixedly fastened in the carriage and provided with an internal screw thread. At the free end of the screw-spindle 56 an adjustment wheel or a crank handle is attached.

Inside an upper member of the block-shaped first carriage, protruding from the side plates 44 of the supplementary frame 42, two guide rods 64 are guided transversely to the displacement-direction of the carriage, the guide rods 64 being connected to form a closed frame at both ends by means of transverse stiffenings 66, 68, the closed frame forming a second carriage 62. A screw spindle 70 stationarily fastened in the end-sided transverse stiffening 68 by means of a pivot bearing 72 and engaging a screw member provided in the first carriage and carrying an internal screw thread serves as a driving means for the second carriage. Through rotation of an adjusting wheel 74 provided at the free end of the spindle 70 or a crank the second carriage 62 is displaced transversely to the displacement direction of the first carriage 54 and also to the ring bending plane.

On the transverse stiffening 66 of the second carriage 62 adjacent to the front side of the bending machine, a pressure roller 80, concavely formed in correspondence to the pipe profiles, is provided, which laterally engages the upwardly slanted or inclined, annularly bent profile behind the final bending roller. Thereby, a force acting in transverse direction with respect to the ring bending plane can be exerted on the annularly bent profile or work piece. According to FIG. 2, the circumference of the pressure roller is formed by two opposingly arranged conical sections, the tapered casing ends of which are connected by means of a central concave area. Pressure roller 80 is rotatably mounted in a roller frame 76, which itself is mounted in a freely rotatable manner about an axle bolt 78 extending perpendicularly to the pressure roller axis and mounted in the transverse stiffening 66.

In order to operate the ring bending machine converted into a helical or spiral bending machine by means of the supplementary frame 42 according to the present invention, the longitudinal centre of pressure roller 80 is initially adjusted to the bending radius of an end of a, for example a pre-bent, profile arriving in the ring bending plane with the help of the first carriage 54. Then, with the help of the second carriage 62, pressure roller 80 is adjusted forwardly from its rear-side terminal position shown in FIG. 2, in which its circumference is adjacent to the side of the processed pipe profile facing the cover housing, until the gradient necessary for the desired spiral progression or shape is reached.

If, instead of a right-handed spiral achieved through the above described operation, a left-handed spiral is to be provided, the rotational direction of bending rollers 32, 34 or their driving means is reversed, and the supplementary frame 42 is mounted and fixedly attached on the right-hand inclined trapezium side of the cover housing as shown in FIG. 1, if necessary after a there installed rectifier roller has been removed. The adjusting wheel 60 for the longitudinal displacement of the first carriage 54 is, with this mounting of the supplementary frame, provided on the upper end thereof.

Obviously, the invention is not limited to the shown and described embodiments. If necessary, the central bending roller 36 can also be provided with driving means. In order to mount the supplementary frame, there can be provided different resting or connecting surfaces instead of the described narrow sides corresponding to trapezium sides.

I claim:

1. A Ring bending machine for pipes and profile rods made of metal, comprising:

a) two supporting shafts supported in a spaced relation to each other in a carrier plate and operatively associated with means for rotatably driving said two supporting shafts, b) a pressing shaft arranged perpendicularly with respect to the spacing of said two supporting shafts and in an adjustable manner, c) a slender cover housing for covering said carrier plate, said pressing and supporting shafts and said driving means, each of said supporting shafts and pressing shaft extending through said cover housing and exterior thereof, d) a bending roller provided on each of said supporting shafts and pressing shaft, said bending roller adapted to form a desired profile and bending plane in the pipe or rod to be bent, e) a supplementary frame positioned exterior of said cover housing and attached to said carrier plate by means for attaching said supplementary frame to said carrier plate, f) said supplemental frame comprising first and second carriages perpendicularly displaceable with respect to each other, at least one of said first and second carriages provided with a pressure roller for laterally guiding the pipe or rod to be bent in spaced relation to said bending roller, g) whereby displacement of said first and said second carriages perpendicularly to each other in said supplementary frame will reposition said pressure roller on said carriages and provide selective adjustment of the bending radius and the helical gradient relative to the bending plane of a rod or pipe to be bent.

2. A Ring bending machine according to claim 1, and wherein said supplementary frame comprises at least two elongated side plates rigidly interconnected in a spaced relation, and at least partially overlying said cover housing at said side surface and including connecting bores coaxially aligned with throughbores extending though each of said carrier plate and said cover housing.

3. A Ring bending machine according to claim 2, and wherein said first carriage is displaceable on guiding columns extending parallel to the longitudinal axis of said at least two side plates of said supplementary frame, said at least two side plates interconnected at respective ends by transverse stiffening members, said first carriage is driven in a longitudinally displaceable manner along said guiding columns by a first screw spindle stationarily mounted on said supplementary frame and operatively engaging a screw member mounted in said first carriage.

4. A Ring bending machine according to claim 4, and wherein said second carriage is provided with parallel guiding rods maintained in spaced relationship by means of second transverse stiffening members, said guiding rods being guided through said first carriage and transverse to the displacement direction thereof, a driving means for said second carriage, said driving means comprising a second screw spindle stationarily supported on said second transverse stiffening members and adjacent a first end of said guiding rod for operatively engaging said screw member supported in said first carriage, and at a second opposite end of said guiding rod a roller frame is provided for supporting said pressure roller and including an axle bolt for rotationally supporting said pressure roller, said axle bolt extending perpendicular to the axis of said pressure roller.

5. A Ring bending machine according to claim 4, and further comprising a digital meter for at least one of calibration or retrieval of predetermined adjustment positions of said pressure roller, said digital meter comprising at least one of an optical or acoustical display and operationally coupled with said first and second screw spindles of said first and second carriages.

6. A Ring bending machine according to claim 4, and wherein said first carriage includes an upper member substantially protruding from said side plates of said supplementary frame and through which said second carriage is guided, whereby said pressure roller supported on said second carriage is thereby disposed a distance from one of said bending roller and functions as an exit roller of said ring bending machine.

7. A ring bending machine for pipes and profile rods made of metal, comprising:

a) two supporting shafts supported in a spaced relation to each other in a carrier plate and operatively associated with means for rotatably driving said two supporting shafts, b) a pressing shaft arranged perpendicularly with respect to the spacing of said two supporting shafts and in an adjustable manner, c) a slender cover housing for covering said carrier plate, said shafts and said driving means, at least one end of each of said shafts extending through said cover housing and exterior thereof, d) a bending roller provided on said at least one end of each of said shafts, said bending roller adapted to provide a desired profile and bending plane in the pipe or rod to be bent, e) a supplementary frame positioned exterior of said cover housing and attached to said carrier plate by means for attaching said supplementary frame to said carrier plate, f) said supplemental frame comprising first and second carriages perpendicularly displaceable with respect to each other, at least one of said first and second carriages provided with a pressure roller for laterally guiding the pipe or rod to be bent in spaced relation to said bending roller, g) whereby said first and said second carriages being displaced perpendicularly to each other in said supplementary frame to cause repositioning of said pressure roller on said carriages and selective adjustment of the bending radius and the helical gradient relative to the bending plane of a rod or pipe to be bent, and h) said cover housing conforming to said carrier plate having a generally isosceles trapezium shape in a vertical plane extending perpendicular to each of said shafts, said supplementary frame is mounted to said cover housing on a slanted trapezium side surface thereof, and fixedly aligned therewith along a longitudinal axis thereof.

8. A Ring bending machine according to claim 7, and further comprising at least one of markers or indicators moveable with each of said first and second carriages, said at least one of markers or indicators cooperate with scales stationarily provided on at least one of said supplementary frame or said first carriage.

9. A Supplementary frame for attachment to a ring bending machine defining a ring bending plane for providing an elongated work piece made of metal, with a helical gradient, said supplementary frame comprising:

a) a frame member having first and second carriages perpendicularly displaceable with respect to each other therein;

b) a pressure roller provided on at least one of said first and second carriages whereby selective displacement of said first and second carriages will cause said pressure roller to engage a work piece bent in the ring bending plane of the ring bending machine as it exits therefrom to selectively exert a force against the work piece transverse to the ring bending plane of said ring bending machine.

10. A Supplementary frame according to claim 9, and wherein said frame member including two elongated sides plates rigidly interconnected in a spaced relation, and at least of said first and second carriages is displaceable on guiding columns extending parallel to the longitudinal axis of said at least two side plates interconnected at respective ends by transverse stiffening members, said at least one of said first and second carriages is driven in a longitudinally displaceable manner along said guiding columns by a first screw spindle.

11. Supplementary frame according to claim 10, and wherein at least another of said first and second carriages is provided with parallel guiding rods maintained in a spaced relationship by means of second transverse stiffening members, said guiding rods being guided through said first carriage and transverse to the displacement direction thereof a, driving means for said second carriage, said driving means comprising a second screw spindle stationarily supported on said second transverse stiffening members and adjacent a first end of said guiding rod for operatively engaging said screw member supported in said first carriage, and at a second opposite end of said guiding rod a roller frame is provided for supporting said pressure roller and including an axle bolt for rotationally supporting said pressure roller, said axle bolt extending perpendicular to the axis of said pressure roller.

12. A supplementary frame for attachment to a ring bending machine defining a ring bending plane for providing an elongated work piece made of metal, with a helical gradient, said supplementary frame comprising:

a) a frame member having first and second carriages perpendicularly displaceable with respect to each other therein;

b) a pressure roller provided on at least one of said first and second carriages whereby selective displacement of said first and second carriages will cause said pressure roller to engage a work piece bent in the ring bending plane of the ring bending machine as it exits therefrom to selectively exert a force against the work piece transverse to the ring bending plane of the ring bending machine;

c) said frame member further comprising at least two elongated side plates rigidly interconnected in a spaced relation, at least one of said first and second carriages is displaceable on guiding columns extending parallel to the longitudinal axis of said at least two side plates and interconnected at respective ends by transverse stiffening members, said at least one of said first and second carriages is driven in a longitudinally displaceable manner along said guiding columns by a first screw spindle;

d) at least another of said first and second carriages is provided with parallel guiding rods maintained in a spaced relationship by means of second transverse stiffening members, said guiding rods being guided through said first carriage and transverse to the displacement direction thereof e) driving means for said second carriage, said driving means comprising a second screw spindle stationarily supported on said second transverse stiffening members and adjacent a first end of said guiding rod for operatively engaging said screw member supported in said first carriage;

f) at a second opposite end of said guiding rod a roller frame is provided for supporting said pressure roller and including an axle bolt for rotationally supporting said pressure roller, said axle bolt extending perpendicular to the axis of said pressure roller; and, g) at least one of markers or indicators movable with each of said first and second carriages, said at least one of markers or indicators cooperate with scales provided on at least one of said supplementary frame or said first carriage.

13. A supplementary frame for attachment to a ring bending machine defining a ring bending plane for providing an elongated work piece made of metal, with a helical gradient, said supplementary frame comprising:

a) a frame member having first and second carriages perpendicularly displaceable with respect to each other therein;

b) a pressure roller provided on at least one of said first and second carriages whereby selective displacement of said first and second carriages will cause said pressure roller to engage a work piece bent in the ring bending plane of the ring bending machine as it exits therefrom to selectively exert a force against the work piece transverse to the ring bending plane of the ring bending machine;

c) said frame member further comprising at least two elongated side plates rigidly interconnected in a spaced relation, at least one of said first and second carriages is displaceable on guiding columns extending parallel to the longitudinal axis of said at least two side plates and interconnected at respective ends by transverse stiffening members, said at least one of said first and second carriages is driven in a longitudinally displaceable manner along said guiding columns by a first screw spindle;

d) at least another of said first and second carriages is provided with parallel guiding rods maintained in a spaced relationship by means of second transverse stiffening members, said guiding rods being guided through said first carriage and transverse to the displacement direction thereof;

e) driving means for said second carriage, said driving means comprising a second screw spindle stationarily supported on said second transverse stiffening members and adjacent a first end of said guiding rod for operatively engaging said screw member supported in said first carriage;

f) at a second opposite end of said guiding rod a roller frame is provided for supporting said pressure roller and including an axle bolt for rotationally supporting said pressure roller, said axle bolt extending perpendicular to the axis of said pressure roller; and, g) a digital meter for at least one of calibration or retrieval of predetermined adjustment positions of said pressure roller, said digital meter comprising at least one of an optical or acoustical display and operationally coupled with said first and second screw spindles of said first and second carriages.

* * * * *